US008877412B2

(12) United States Patent
Ide et al.

(10) Patent No.: US 8,877,412 B2
(45) Date of Patent: Nov. 4, 2014

(54) IMAGE FORMING APPARATUS AND PROCESS CARTRIDGE

(75) Inventors: Kenta Ide, Kanagawa (JP); Kosuke Narita, Kanagawa (JP); Hirofumi Nakamura, Kanagawa (JP); Kazuhiro Koseki, Kanagawa (JP); Akihiro Kawasaki, Kanagawa (JP); Shigeto Hashiba, Kanagawa (JP); Takahiro Suzuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/554,587

(22) Filed: Jul. 20, 2012

(65) Prior Publication Data

US 2013/0236820 A1 Sep. 12, 2013

(30) Foreign Application Priority Data

Mar. 7, 2012 (JP) ..... 2012-050622

(51) Int. Cl.
*G03G 15/00* (2006.01)
*G03G 21/18* (2006.01)

(52) U.S. Cl.
USPC ..... 430/56; 399/111; 399/159

(58) Field of Classification Search
USPC ..... 430/56, 60, 65; 399/111, 159
See application file for complete search history.

(56) References Cited

U.S. PATENT DOCUMENTS

| | | | | |
|---|---|---|---|---|
| 5,363,176 | A | 11/1994 | Ishihara et al. | |
| 7,561,828 | B2 | 7/2009 | Nukada et al. | |
| 2006/0013615 | A1 | 1/2006 | Nukada et al. | |
| 2006/0014090 | A1 | 1/2006 | Shiino et al. | |
| 2006/0014091 | A1 | 1/2006 | Nukada et al. | |
| 2006/0014092 | A1 | 1/2006 | Nukada et al. | |
| 2009/0010664 | A1 * | 1/2009 | Nukada et al. | 399/49 |
| 2010/0183330 | A1 * | 7/2010 | Wada et al. | 399/116 |
| 2013/0236820 | A1 | 9/2013 | Ide et al. | |

FOREIGN PATENT DOCUMENTS

| | | |
|---|---|---|
| JP | A-2001-312075 | 11/2001 |
| JP | A-2004-4292 | 1/2004 |
| JP | A-2008-281723 | 11/2008 |
| JP | A-2009-25506 | 2/2009 |
| JP | P-4456951 | 2/2010 |

OTHER PUBLICATIONS

Diamond, et al., (eds.) Handbook of Imaging Materials, 2nd ed., New York: Marcel-Dekker, Inc. (Nov. 2001) pp. 145-164.
Oct. 16, 2013 Office Action issued in U.S. Appl. No. 13/606,787.
U.S. Appl. No. 13/606,787, filed Sep. 7, 2012 in the name of Keiko Ono et al.

* cited by examiner

*Primary Examiner* — Mark F Huff
*Assistant Examiner* — Rachel Zhang
(74) *Attorney, Agent, or Firm* — Oliff PLC

(57) ABSTRACT

An image forming apparatus includes at least an electrophotographic photoreceptor having at least a conductive support, an undercoat layer, and a photosensitive layer; a charging device that charges the surface of the electrophotographic photoreceptor in a contact charging mode, in which only DC voltage is applied; an electrostatic latent image forming device that exposes the surface of the charged electrophotographic photoreceptor to form an electrostatic latent image; a developing device that develops the electrostatic latent image by a developer to form a toner image; and a transfer device that directly transfers the toner image from the electrophotographic photoreceptor to a transfer medium; and does not include an erasing device for erasing the surface of the electrophotographic photoreceptor after the toner image is transferred onto the transfer medium by the transfer device and before the surface of the electrophotographic photoreceptor is charged by the charging device.

7 Claims, 3 Drawing Sheets

IMAGE FORMING APPARATUS AND PROCESS CARTRIDGE

CROSS-REFERENCE TO RELATED APPLICATIONS

This application is based on and claims priority under 35 USC 119 from Japanese Patent Application No. 2012-050622 filed Mar. 7, 2012.

BACKGROUND

1. Technical Field

The present invention relates to an image forming apparatus and a process cartridge.

2. Related Art

Image formation in an electrophotographic mode has been recently used in a wide range of image forming apparatuses such as copying machines and laser printers.

SUMMARY

According to an aspect of the invention, there is provided an image forming apparatus, which includes at least an electrophotographic photoreceptor having at least a conductive support, an undercoat layer provided on the conductive support, containing metal oxide particles and an electron accepting compound having an anthraquinone structure with the amount of the electron accepting compound being from 1 part by weight to 5 parts by weight with respect to 100 parts by weight of the metal oxide particles, and having a volume resistivity, as measured by an AC impedance method, in the range of $3.5\times10^8$ Ωm to $1.0\times10^9$ Ωm, and a photosensitive layer provided on the undercoat layer; a charging unit that charges the surface of the electrophotographic photoreceptor in a contact charging mode in which only DC voltage is applied; an electrostatic latent image forming unit that exposes the surface of the charged electrophotographic photoreceptor to form an electrostatic latent image; a developing unit that develops the electrostatic latent image by a developer to form a toner image; and a transfer unit that directly transfers the toner image from the electrophotographic photoreceptor to a transfer medium; and which does not include an erasing unit for erasing the surface of the electrophotographic photoreceptor after the toner image is transferred onto the transfer medium by the transfer unit and before the surface of the electrophotographic photoreceptor is charged by the charging unit.

BRIEF DESCRIPTION OF THE DRAWINGS

Exemplary embodiments of the present invention will be described in detail based on the following figures, wherein.

DETAILED DESCRIPTION

Figure 1:
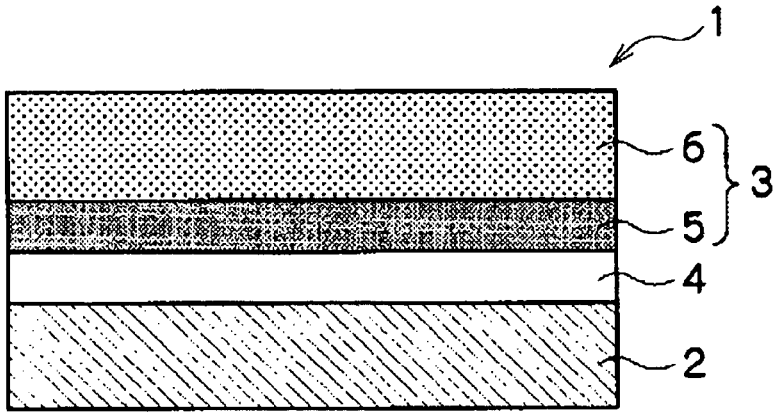
FIG. 1 is a schematic diagram showing a cross-section of a part of the electrophotographic photoreceptor according to the present exemplary embodiment.

Hereinbelow, exemplary embodiments will be described in detail. Further, in the drawings, the same or equivalent elements have the same symbols attached and duplicate explanation may be omitted in some cases.

Image Forming Apparatus

The image forming apparatus according to the present exemplary embodiment includes an electrophotographic photoreceptor; a charging unit that charges the surface of the electrophotographic photoreceptor; an electrostatic latent image forming unit that exposes the surface of the charged electrophotographic photoreceptor to form an electrostatic latent image; a developing unit that develops the electrostatic latent image by a developer to form a toner image; and a transfer unit that transfers the toner image onto a transfer medium.

For an image forming apparatus having no erasing unit for erasing the surface of the electrophotographic photoreceptor after the toner image formed on the surface of the electrophotographic photoreceptor is transferred onto a transfer body by a transfer unit and before the surface of the electrophotographic photoreceptor is charged by the charging unit (which will be hereinafter referred to as an erase-less system), a charging unit in a contact charging mode, in which only DC voltage is applied, is employed as the charging unit and a transfer unit in a direct transfer mode, which directly transfers the toner image from the electrophotographic photoreceptor to the transfer medium, is employed as the transfer unit.

In addition, for the image forming apparatus configured as above, an electrophotographic photoreceptor having at least an undercoat layer containing metal oxide particles and an electron accepting compound having an anthraquinone structure with an amount of the electron accepting compound being from 1 part by weight to 5 parts by weight with respect to 100 parts by weight of the metal oxide particles, and having a volume resistivity, as measured by an AC impedance method, in the range of $3.5\times10^8$ Ωm to $1.0\times10^9$ Ωm; and a photosensitive layer, is employed as the electrophotographic photoreceptor on the conductive support.

Herein, the erase-less systems in the related art remove the surface potential difference between the exposure portion and the non-exposure portion of the electrophotographic photoreceptor by reverse voltage (reverse bias) imparted by the transfer unit that transfers the toner image from the electrophotographic photoreceptor.

However, for the purpose of coping with the demand for a smaller size and a higher speed, in an erase-less system employing a contact charging mode in which only a DC voltage is applied and a direct transfer mode, the surface potential difference between the exposure portion and the non-exposure portion of the electrophotographic photoreceptor tends to be hardly removed, leading to generation of image density unevenness in some cases.

It is thought that the reason therefor is as follows. Since in the direct transfer mode, the resistance value of a transfer medium (for example, a recording medium such as paper) is high, the reverse voltage (reverse bias) imparted to the electrophotographic photoreceptor becomes low by a transfer unit. In addition, in the contact charging mode in which only a DC voltage is applied, the surface potential difference between the exposure portion and the non-exposure portion of the electrophotographic photoreceptor is not removed.

Accordingly, in the erase-less system employing a contact charging mode in which only a DC voltage is applied and a direct transfer mode in the image forming apparatus according to the present exemplary embodiment, when the electrophotographic photoreceptor is configured as above, generation of density unevenness due to the surface potential difference between the exposure portion and the non-exposure portion of the electrophotographic photoreceptor is suppressed.

The reason therefor is not clear, but is presumed as follows.

It is thought that when the volume resistivity of the undercoat layer of the electrophotographic photoreceptor is adjusted to a low range of $3.5\times10^{8}$ Ωm to $1.0\times10^{9}$ Ωm and the resistance value itself of the undercoat layer is decreased, the resistance of the electrophotographic photoreceptor is lowered, and although the reverse voltage (reverse bias) imparted to the electrophotographic photoreceptor is low, the charges easily flow in the photosensitive layer.

It is also thought that when the volume resistivity of the undercoat layer of the electrophotographic photoreceptor is lowered and an electron accepting compound having an anthraquinone structure is then incorporated into the undercoat layer of the electrophotographic photoreceptor in a large amount of 1 part by weight to 5 parts by weight with respect to 100 parts by weight of the metal oxide particles, the charge injection occurring between the undercoat layer and a photosensitive layer (a single-layered photosensitive layer having a charge generating/charge transporting function or a charge generating layer in the function-separated photosensitive layer) disposed in contact with the undercoat layer is carried out without intervention (which means that the charge injection is readily conducted), and as a result, even though the reverse voltage (reverse bias) imparted to the electrophotographic photoreceptor is lowered, removal of the surface potential difference between the exposure portion and the non-exposure portion of the electrophotographic photoreceptor is attained.

Therefore, it is thought that in the erase-less system employing a contact charging mode in which only a DC voltage is applied and a direct transfer mode in the image forming apparatus according to the present exemplary embodiment, when the electrophotographic photoreceptor is configured as above, generation of density unevenness due to the surface potential difference between the exposure portion and the non-exposure portion of the electrophotographic photoreceptor is suppressed.

Moreover, in the image forming apparatus according to the present exemplary embodiment, when an electron accepting compound having a hydroxyanthraquinone structure is employed as the electron accepting compound having an anthraquinone structure, generation of density unevenness due to the surface potential difference between the exposure portion and the non-exposure portion of the electrophotographic photoreceptor is further suppressed.

Hereinbelow, the image forming apparatus according to the present exemplary embodiment will be described in detail with respect to the respective members.

[Electrophotographic Photoreceptor]

FIG. 1 schematically shows the cross-section of a part of the electrophotographic photoreceptor according to the present exemplary embodiment. The electrophotographic photoreceptor 1 shown in FIG. 1 includes, for example, a function-separated photosensitive layer 3 in which a charge generating layer 5 and a charge transporting layer 6 are provided separately, and has a structure in which an undercoat layer 4, the charge generating layer 5, and the charge transporting layer 6 are laminated on the conductive support 2 in this order.

Further, in the present specification, the insulating property means that the volume resistivity is in the range of equal to or more than $10^{12}$ Ωcm, while the conductivity means that the volume resistivity is in the range equal to or less than $10^{10}$ Ωcm.

Hereinbelow, the respective elements of the electrophotographic photoreceptor 1 will be described.

Conductive Support

As the conductive support 2, any one used in the related art may be used. Examples of the conductive support include metals such aluminum, nickel, chromium, and stainless steel, plastic films having thin films of, for example, aluminum, titanium, nickel, chromium, stainless steel, gold, vanadium, tin oxide, indium oxide, or ITO, and paper or plastic films coated or impregnated with a conductivity imparting agent.

The shape of the conductive support 2 is not restricted to a drum form and may be a sheet shape or a plate shape.

When a metal pipe is used as the conductive support 2, its surface may be in an untreated state or may be subjected to a treatment such as mirror surface cutting, etching, anodic oxidation, rough cutting, centerless grinding, sandblasting, and wet honing in advance.

Undercoat Layer

The undercoat layer 4 may contain at least metal oxide particles and a specific electron accepting compound, and if necessary, other materials.

Examples of the undercoat layer 4 include ones formed by dispersing metal oxide particles and a specific electron accepting compound in a binder resin.

Metal Oxide Particles

Examples of the metal oxide particles include particles of, for example, zinc oxide, titanium oxide, tin oxide, or zirconium oxide, and these may be used as a mixture of two or more kinds thereof.

The volume average particle diameter of the metal oxide particles may be, for example, from 50 nm to 200 nm, preferably from 60 nm to 180 nm, and more preferably from 70 nm to 120 cm.

Further, the volume average particle diameter of the metal oxide particles is measured by using, for example, a laser diffraction particle size distribution measurement device (LA-700: manufactured by HORIBA, Ltd.). As the measurement method, a sample in the state of a dispersion is prepared to give a solid content of 2 g, and ion exchange water is added thereto to adjust the amount of the solution to 40 ml. The solution is then charged into the cell until an appropriate concentration is given, and after waiting for 2 minutes, the measurement is carried out. The obtained volume average particle diameter for each obtained channel is cumulated from the side of the smaller volume average particle diameter, and the 50% cumulative volume average particle diameter is defined as the volume average particle diameter.

The content of the metal oxide particles included in the undercoat layer 4 may be, for example, in the range equal to or more than 2.5% by weight, preferably in the range of 10% by weight to 70% by weight, and more preferably in the range of 30% by weight to 50% by weight, with respect to the total amount of the undercoat layer.

The metal oxide particles may be subjected to a surface treatment with a coupling agent having an amino group. The metal oxide particles may be subjected to a surface treatment with a coupling agent other than a coupling agent having an amino group.

Examples of the coupling agent having an amino group include a silane coupling agent, a titanate-based coupling agent, an aluminum-based coupling agent, and a surfactant. Particularly, the surface treating agent for suppressing fog by adjusting the resistance, may be, for example, a silane coupling agent.

The silane coupling agent is an organic silane compound (organic compound containing a silicon atom), and specific examples thereof include γ-aminopropyltriethoxysilane, N,N-bis(β-hydroxyethyl)-γ-aminopropyltriethoxysilane, N-2-(aminoethyl)-3-aminopropyltrimethoxysilane, N-2-(aminoethyl)-3-aminopropylmethyldimethoxysilane, and N-phenyl-3-aminopropyltrimethoxysilane.

Whether the metal oxide particles are surface-treated with a coupling agent having an amino group or not is confirmed by molecular structure analysis by means of, for example, FT-IR, Raman spectroscopy, or XPS.

The method for surface treatment of the metal oxide particles is not particularly limited, but examples thereof include a dry method and a wet method.

In the case of carrying out the surface treatment by the dry method, for example, while stirring metal oxide particles with, for example, a mixer having a high shear force, a direct surface treatment agent is added dropwise or a surface treatment agent dissolved in an organic solvent is added dropwise, and sprayed together with dry air or nitrogen gas. Dropwise addition or spraying is carried out, for example, at a temperature equal to or lower than the boiling point of a solvent. After dropwise addition or spraying, the solution may be further heated to a temperature equal to or higher than 100° C. for printing.

For the wet method, for example, metal oxide particles are stirred in a solvent and dispersed using, for example, ultrasonic waves, a sand mill, an attritor, or a ball mill, and a surface treatment agent solution is added thereto, and stirred or dispersed therein, and then, the solvent is removed. Examples of the method for removing the solvent include filtration and distillation. After removing the solvent, printing may also be carried out at a temperature equal to or higher than 100° C. In the wet method, moisture content of the metal oxide particles may be removed before the addition of a surface treatment agent, and examples of such a method include a method in which the moisture content of the metal oxide particles is removed by stirring and heating in a solvent used for a surface treatment agent solution and a method in which the moisture content of the metal oxide particles is removed while subjecting it to azeotropy with a solvent.

The amount of the surface treatment agent attached on the surface (which may be hereinafter referred to as "a surface treatment amount" in some cases) with respect to 100 parts by weight of the metal oxide particles may be, for example, from 0.5 part by weight to 3 parts by weight, preferably from 0.5 part by weight to 2.0 parts by weight, and more preferably from 0.75 part by weight to 1.30 parts by weight.

Examples of the method for measuring the surface treatment amount (that is, amount of the surface treatment agent attached on the metal oxide particles) include methods for molecular structure analysis by means of, for example, FT-IR, Raman spectroscopy, or XPS.

Electron Accepting Compound

The electron accepting compound is an electron accepting compound having an anthraquinone structure. Herein, "the compound having an anthraquinone structure" is specifically at least one selected from anthraquinone and anthraquinone derivatives, and more specifically the electron accepting compound may be a compound represented by the following formula (1).

Formula (1)

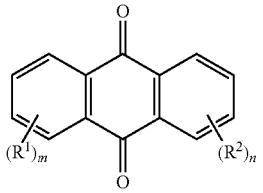

In the formula (1), $R^1$ and $R^2$ each independently represent a hydroxyl group, a methyl group, a methoxymethyl group, a phenyl group, or an amino group, and m and n each independently represent an integer of 0 to 4.

Further, the compound of the formula (1), in which m and n are both 0, is anthraquinone, and the compound of the formula (1), in which at least one of m and in is an integer of 1 to 4, is an anthraquinone derivative. That is, the anthraquinone derivatives mean anthraquinone compounds wherein at least one of hydrogen atoms contained in the anthraquinone is substituted by a substituent such as a hydroxyl group, a methyl group, methoxymethyl group, a phenyl group, and an amino group.

Particularly, among the above compounds, suitable examples of the electron accepting compound include anthraquinone of the formula (1), wherein m and n are both 0, and hydroxyanthraquinone of the formula (1), wherein $R^1$ is a hydroxyl group, m is from 1 to 3, and in is 0.

Specific examples of the electron accepting compound include anthraquinone, purpurin, alizarin, quinizarin, ethyl anthraquinone, and aminohydroxyanthraquinone.

Whether the undercoat layer 4 contains an electron accepting compound having an anthraquinone structure is confirmed by an analysis method such as gas chromatography, liquid chromatography, FT-IR, Raman spectroscopy, and XPS.

The content of the electron accepting compound contained in the undercoat layer 4 is from 1 part by weight to 5 parts by weight, and preferably from 2 parts by weight to 4 parts by weight, with respect to 100 parts by weight of the metal oxide particles contained in the undercoat layer 4.

The content ratio of the metal oxide particles and the electron accepting compound contained in the undercoat layer 4 of the electrophotographic photoreceptor is confirmed by an analysis method such as an NMR spectrum, XPS, atomic absorption spectrometry, and electron beam micro-analyzer.

Binder Resin

As the binder resin contained in the undercoat layer 4, polymeric compounds, such as acetal resins such as a polyvinyl butyral resin, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins, and urethane resins, charge transporting resins having charge transporting groups, or conductive resins such as a polyaniline resin are used.

The content of the binder resin contained in the undercoat layer may be, for example, in the range of 5% by weight to 60% by weight, preferably from 10% by weight to 55% by weight, and more preferably from 30% by weight to 50% by weight, with respect to the total amount of the undercoat layer.

Other Additives

Resin particles may be added to the undercoat layer 4 so as to adjust the surface roughness thereof. Examples thereof include silicone resin particles and crosslinking PMMA resin particles.

Further, the surface of the undercoat layer 4 may be subjected to grinding so as to adjust the surface roughness thereof. Examples of the grinding method include buffing grinding, sandblasting treatment, wet honing, and grinding treatments.

Furthermore, a curing agent or a curing catalyst may be added to the undercoat layer 4. When the curing agent or the curing catalyst are added, a curing reaction is sufficiently performed, and thus, unnecessary elution from the undercoat layer 4 is suppressed, and increase in the residual potential or decrease in the sensitivity is suppressed.

Examples of the curing agent include blocked isocyanate compounds and melamine resins, and blocked isocyanate compounds are suitably used. Since blocked isocyanate compounds have isocyanate groups masked with blocking agents, gelling and thickening of the coating liquid are suppressed over time, and accordingly, the working properties are excellent.

Examples of the curing catalyst include known materials that are generally used, and the curing catalyst is preferably selected from acid catalysts, amine-based catalysts, and metal compound-based catalysts. Further, when a melamine resin is used as the curing agent, an acid catalyst is preferably used; and when a blocked isocyanate compound is used, an amine-based catalyst or metal compound-based catalyst is preferably used. Examples of the metal compound-based catalyst include stannous oxide, dioctyl tin dilaurate, dibutyl tin dilaurate, dibutyl tin diacetate, zinc naphthenate, antimony trichloride, potassium oleate, sodium O-phenylphenate, bismuth nitrate, ferric chloride, tetra-n-butyl tin, tetra(2-ethylhexyl) titanate, cobalt 2-ethylhexoate, and ferric 2-ethylhexoate.

The addition amount of the curing catalyst is preferably from 0.0001% by weight to 0.1% by weight, and more preferably from 0.001% by weight to 0.01% by weight, with respect to the amount of the curing agent.

Formation of Undercoat Layer

When the undercoat layer 4 is formed, a coating liquid formed by adding the above-described components to a solvent (coating liquid for forming an undercoat layer) is used.

Examples of the solvent include organic solvents, and specifically, aromatic hydrocarbon-based solvents such as toluene and chlorobenzene; aliphatic alcohol-based solvents such as methanol, ethanol, n-propanol, iso-propanol, and n-butanol; ketone-based solvents such as acetone, cyclohexanone, and 2-butanone; halogenated aliphatic hydrocarbon solvents such as methylene chloride, chloroform, and ethylene chloride; cyclic or linear ether-based solvents such as tetrahydrofuran, dioxane, ethylene glycol, and diethyl ether; and ester-based solvents such as methyl acetate, ethyl acetate, and n-butyl acetate. These solvents may be used singly or in combination of two or more kinds thereof, and are not particularly limited, but a solvent for dissolving the binder resin is preferably used.

The amount of the solvent used in the coating liquid for forming an undercoat layer is not particularly limited as long as the binder resin is dissolved therein, but it may be, for example, from 0.05 part by weight to 200 parts by weight, with respect to 1 part by weight of the binder resin.

Further, for a method for dispersing the metal oxide particles in a coating liquid for forming an undercoat layer, media dispersers such as a ball mill, a vibration ball mill, an attritor, and a sand mill, and medialess dispersers such as a stirrer, an ultrasonic disperser, a roll mill, and a high-pressure homogenizer may be used. Further, examples of the high-pressure homogenizer include a collision-type homogenizer in which a dispersion is dispersed by liquid-liquid collision, and liquid-wall collision under high pressure, and a passing-through-type homogenizer in which a dispersion is dispersed by passing the dispersion through thin flow paths under high pressure.

An appropriate dispersing method is preferably chosen so as to adjust the volume resistivity of the obtained undercoat layer 4 to the range as defined later, and specifically, a sand mill using glass beads, a ball mill, or the like is preferably used for the dispersion. The particle diameter of the glass beads is controlled according to the components such as metal oxide particles and binder resins to be used, and specifically the particle diameter may be from 0.1 mm to 10 mm.

Examples of the method of coating the coating liquid for forming an undercoat layer on the conductive support 2 include a dip coating method, an extrusion coating method, a wire bar coating method, a spray coating method, a blade coating method, a knife coating method, and a curtain coating method.

After coating the coating liquid for forming an undercoat layer on the conductive support 2, heating for drying or curing is preferably carried out. The curing temperature and the heating time in the case of using a curing agent or a curing catalyst are preferably adjusted depending on the kind of the curing agent or the curing catalyst to be used, and specifically, the heating may be carried out, for example, at a temperature of 160° C. to 200° C. for 15 minutes to 40 minutes.

Physical Properties of Undercoat Layer

The thickness of the undercoat layer 4 is equal to or more than 10 μm, and more preferably from 15 μm to 40 μl.

The volume resistivity of the undercoat layer 4 is in the range of $3.5\times10^8$ Ωm to $1.0\times10^9$ Ωm, preferably in the range of $4.0\times10^8$ Ωm to $9.5\times10^8$ Ωm, and more preferably in the range of $4.5\times10^8$ Ωm to $9.0\times10^8$ Ωm, in the measurement using an AC impedance method.

The detailed method for measuring the volume resistivity of the undercoat layer 4 is as follows.

First, the impedance of the undercoat layer 4 is measured. In a sample for impedance measurement, the conductive support such as an aluminum pipe is used as a cathode, a gold electrode is used as an anode, an AC voltage with 1 Vp-p is applied from the high-frequency side in the frequency range of 1 MHz to 1 mHz, and the AC impedance of each sample is measured. By fitting a graph with the Cole-Cole plot obtained in the measurement to the equivalent circuit of parallel RC, the volume resistivity of the undercoat layer 4 is obtained.

Further, the method for preparing an undercoat layer sample for measuring the volume resistivity from an electrophotographic photoreceptor is as follows.

For example, coating films such as a charge generating layer and a charge transporting layer, which coat the undercoat layer, are removed using a solvent such as acetone, tetrahydrofuran, methanol, and ethanol, and the gold electrode is mounted by a vacuum deposition method or a sputtering method on the exposed undercoat layer to provide an undercoat layer sample for measuring the volume resistivity.

Examples of the method for adjusting the volume resistivity of the undercoat layer 4 within the above ranges include a method for adjusting the addition amount or the particle diameter of the metal oxide particles, and a method for modifying the method for dispersing the metal oxide particles in the coating liquid for forming an undercoat layer.

As the particle diameter of the metal oxide particles is increased, the volume resistivity of the undercoat layer 4 tends to decrease. Further, by increasing the addition amount of the metal oxide particles, the volume resistivity of the undercoat layer 4 tends to increase.

Furthermore, when the dispersibility of the metal oxide particles in the coating liquid for forming an undercoat layer is improved, the volume resistivity of the undercoat layer 4 tends to increase. Specifically, by increasing the dispersion treatment time for the coating liquid for forming an undercoat layer, the volume resistivity of the undercoat layer 4 tends to increase.

Intermediate Layer

An intermediate layer (not shown) may be further provided on the undercoat layer 4 for improving, for example, the electric characteristics, the image quality, maintenance of the image quality, or the adhesiveness of the photosensitive layer. Examples of the binder resins used for the intermediate layer include organic metal compounds containing zirconium atoms, titanium atoms, aluminum atoms, manganese atoms, and silicon atoms, in addition to polymeric resin compounds, for example, acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer is formed using, for example, a coating liquid formed by dissolving the binder resin in a solvent. Examples of the method for coating the coating liquid include known methods such as a dip coating method, an extrusion coating method, a wire bar coating method, a spray coating method, a blade coating method, a knife coating method, and a curtain coating method.

The thickness of the intermediate layer is set to, for example, a range of 0.1 μm to 3 μm.

Charge Generating Layer

The charge generating layer 5 is configured, for example, to have charge generating materials dispersed in a binder resin.

As the charge generating materials, phthalocyanine pigments such as non-metal phthalocyanine, chlorogallium phthalocyanine, hydroxygallium phthalocyanine, dichlorotin phthalocyanine, titanylphthalocyanine, and the like are used, and in particular, chlorogallium phthalocyanine crystals having strong diffraction peaks at least at 7.4°, 16.6°, 25.5°, and 28.3° of Bragg angles)(2θ±0.2° with respect to CuKα characteristic X rays, non-metal phthalocyanine crystals having strong diffraction peaks at least at 7.7', 9.3°, 16.9°, 17.5°, 22.4°, and 28.8° of Bragg angles (2θ+0.2° with respect to CuKα characteristic X rays, hydroxygallium phthalocyanine crystals having strong diffraction peaks at least at 7.5', 9.9°, 12.5°, 16.3°, 18.6°, 25.1°, and 28.3° of Bragg angles (2θ±0.2° with respect to CuKα characteristic X rays, titanyl phthalocyanine crystals having strong diffraction peaks at least at 9.6°, 24.1°, and 27.2° of Bragg angles (2θ±0.2° with respect to CuKα characteristic X rays and the like are used. In addition, examples of other charge generating materials include a quinone pigment, a perylene pigment, an indigo pigment, a bisbenzoimidazole pigment, an anthrone pigment, a quinacridone pigment, and the like. These charge generating materials may be used singly or as a mixture of two or more kinds thereof.

As the binder resins in the charge generating layer 5, for example, polycarbonate resins such as a bisphenol A-type resin and a bisphenol Z-type resin, an acrylic resin, a methacrylic resin, a polyarylate resin, a polyester resin, a polyvinyl chloride resin, a polystyrene resin, an acrylonitrile-styrene copolymer resin, an acrylonitrile-butadiene copolymer, a polyvinyl acetate resin, a polyvinyl formal resin, a polysulfone resin, a styrene-butadiene copolymer resin, a vinylidene chloride-acrylonitrile copolymer resin, a vinyl chloride-vinyl acetate copolymer resin, a vinyl chloride-vinyl acetate-maleic anhydride resin, a silicone resin, a phenol-formaldehyde resin, a polyacrylamide resin, a polyamide resin, or a poly-N-vinylcarbazole resin are used. These binder resins may be used singly or as a mixture of two or more kinds thereof.

The blending ratio (weight ratio) of the charge generating material and the binder resin depends on the materials to be used, but is preferably, for example, in the range of 10:1 to 1:10.

When the charge generating layer 5 is formed, a coating liquid obtained by adding the above-described components to a solvent is used.

In order to disperse the charge generating materials in the binder resin, the coating liquid is subjected to dispersion treatment. Examples of the dispersing unit to be used include media dispersers such as a ball mill, a vibration ball mill, an attritor, and a sand mill, and medialess dispersers such as a stirrer, an ultrasonic disperser, a roll mill, and a high-pressure homogenizer. Further, examples of the high-pressure homogenizer include a collision-type homogenizer in which a dispersion is dispersed by liquid-liquid collision, and a liquid-wall collision under high pressure, and a passing-through-type homogenizer in which a dispersion is dispersed by passing the dispersion through thin flow paths under high pressure.

Examples of the method for coating the coating liquid for forming a charge generating layer thus obtained on the undercoat layer 4 include a dip coating method, an extrusion coating method, a wire bar coating method, a spray coating method, a blade coating method, a knife coating method, and a curtain coating method.

The film thickness of the charge generating layer 5 is preferably set to the range of 0.01 μm to 5 μm.

Charge Transporting Layer

The charge transporting layer 6 is configured to have, for example, charge transporting materials dispersed in a binder resin.

Examples of the charge transporting materials include hole transporting materials such as oxadiazole derivatives such as 2,5-bis(p-diethylaminophenyl)-1,3,4-oxadiazole, pyrazoline derivatives such as 1,3,5-triphenylpyrazoline and 1-[pyridyl-(2)]-3-(p-diethylamino-styryl)-5-(p-diethylaminostyryl) pyrazoline, aromatic tertiary amino compounds such as triphenylamine, N,N'-bis(3,4-dimethylphenyl)-biphenyl-4-amine, tri(p-methylphenyl)aminyl-4-amine, and dibenzylaniline, aromatic tertiary diamino compounds such as N,N'-bis(3-methylphenyl)-N,N'-diphenylbenzidine, N,N'-diphenyl-N,N'-bis(3-methylphenyl)-[1,1']biphenyl-4,4'-diamine, 1,2,4-triazine derivatives such as 3-(4'-diethylaminophenyl)-5,6-di-(4'-methoxyphenyl)-1,2,4-triazine, hydrazone derivatives such as 4-diethylaminobenzaldehyde-1,1-diphenylhydrazone, quinazoline derivatives such as 2-phenyl-4-styryl-quinazoline, benzofuran derivatives such as 6-hydroxy-2,3-di(p-methoxyphenyl)benzofuran, α-stilbene derivatives such as p-(2,2-diphenylvinyl)-N—N-diphenylaniline, enamine derivatives, carbazole derivatives such as N-ethylcarbazole, and poly-N-vinylcarbazole and derivatives thereof, electron transporting materials such as quinone-based compounds such as chloranil and broanthraquinone, tetracyanoquinodimethane-based compounds, fluorenone compounds such as 2,4,7-trinitrofluorenone and 2,4,5,7-tetranitro-9-fluorenone, a xanthone-based compound and a thiophene-based compound, and polymers having a group formed of the above compounds in the main chain or side chain thereof. These charge transporting materials may be used singly or in combination of two or more kinds thereof.

Examples of the binder resin in the charge transporting layer 6 include insulating resins such as biphenyl copolymerization type polycarbonate resins, polycarbonate resins such as a bisphenol A-type resin and a bisphenol Z-type resin, an acrylic resin, a methacrylic resin, a polyarylate resin, a polyester resin, a polyvinyl chloride resin, a polystyrene resin, an acrylonitrile-styrene copolymer resin, an acrylonitrile-butadiene copolymer resin, a polyvinyl acetate resin, a polyvinyl formal resin, a polysulfone resin, a styrene-butadiene copolymer resin, a vinylidene chloride-acrylonitrile copolymer resin, a vinyl chloride-vinyl acetate-maleic anhydride resin, a silicone resin, a phenol-formaldehyde resin, a polyacrylamide resin, a polyamide resin, and chlorinated rubber, and organic photoconductive polymers such as polyvinylcarbazole, polyvinylanthracene, and polyvinylpyrene. These binder resins may be used singly or as a mixture of two or more kinds thereof.

Furthermore, when the charge transporting layer 6 is the surface layer of the electrophotographic photoreceptor (layer disposed farthest from the conductive support 2 of the photosensitive layer), lubricating particles (for example, fluorine-based resin particles and silicone-based resin particles such as silica particles, alumina particles, and polytetrafluoroethylene (PTFE)) may be incorporated into the charge transporting layer 6. These lubricating particles may be contained as a mixture of two or more kinds thereof.

Further, when the charge transporting layer 6 is the surface layer of the electrophotographic photoreceptor, fluorine-modified silicone oil may be added to the charge transporting layer 6. Examples of the fluorine-modified silicone oil include compounds having fluoroalkyl groups.

Further, the weight ratio of the charge transporting materials and the binder resin in the charge transporting layer 6 may be, for example, in the range of 10:1 to 1:5. That is, the content of the charge transporting materials with respect to the total amount of the charge transporting layer 6 may be, for example, in the range of 17% by weight to 91% by weight.

The charge transporting layer 6 is formed using a coating liquid for forming a charge transporting layer obtained by adding the above-described components to a solvent.

Examples of the solvent include known organic solvents, for example, aromatic hydrocarbon-based solvents such as toluene and chlorobenzene, aliphatic alcohol-based solvents such as methanol, ethanol, n-propanol, iso-propanol, and n-butanol, ketone-based solvents such as acetone, cyclohexanone, and 2-butanone, halogenated aliphatic hydrocarbon solvents such as methylene chloride, chloroform, and ethylene chloride, cyclic or linear ether-based solvents such as tetrahydrofuran, dioxane, ethylene glycol, and diethyl ether, and ester-based solvents such as methyl acetate, ethyl acetate, and n-butyl acetate. Further, these solvents may be used singly or in combination of two or more kinds thereof, and the solvents that are mixed and used are not particularly limited as long as they are solvents for dissolving the binder resin as a mixed solvent.

Examples of the method for dispersing lubricating particles in the coating liquid for forming a charge transporting layer include methods using media dispersers such as a ball mill, a vibration ball mill, an attritor, and a sand mill, or medialess dispersers such as a stirrer, an ultrasonic disperser, a roll mill, a high-pressure homogenizer, and nanomizer. Further, examples of the high-pressure homogenizer include a collision-type homogenizer in which a dispersion is dispersed by liquid-liquid collision, and a liquid-wall collision under high pressure, and a passing-through-type homogenizer in which a dispersion is dispersed by passing the dispersion through thin flow paths under high pressure.

Examples of the method for forming the charge transporting layer 6 include a method in which the coating liquid for forming a charge transporting layer is coated and dried on the charge generating layer 5 of the conductive support 2, in which the undercoat layer 4 and the charge generating layer 5 are formed, thereby forming the charge generating layer 6.

Examples of the method for coating the coating liquid for forming a charge transporting layer on the charge generating layer 5 include a dip coating method, an extrusion coating method, a wire bar coating method, a spray coating method, a blade coating method, a knife coating method, and a curtain coating method.

Further, after coating the coating liquid on the charge generating layer 5, heating and drying are carried out to remove the solvent in the coating liquid. The film thickness of the charge transporting layer 6 may be, for example, in the range of 5 μm to 50 μm.

In order to prevent deterioration of the photoreceptor due to ozone or nitrogen oxide generated in the image forming apparatus, or light and heat, additives such as an antioxidant, a light stabilizer, and a heat stabilizer may be added to the respective layers constituting the photosensitive layer 3. Examples of the antioxidant include hindered phenol, hindered amine, paraphenylenediamine, arylalkane, hydroquinone, spirochromane, spiroindanone, derivatives thereof, an organic sulfur compound, and an organic phosphor compound. Examples of the light stabilizer include derivatives of benzophenone, benzazole, dithiocarbamate, and tetramethylpiperidine.

Further, the electrophotographic photoreceptor 1 according to the present exemplary embodiment may be configured such that the charge transporting layer 6 is an outermost layer, but a protective layer may be further formed on the charge transporting layer.

Image Forming Apparatus

Next, the image forming apparatus including the electrophotographic photoreceptor according to the present exemplary embodiment will be described.

First Exemplary Embodiment

Figure 2:
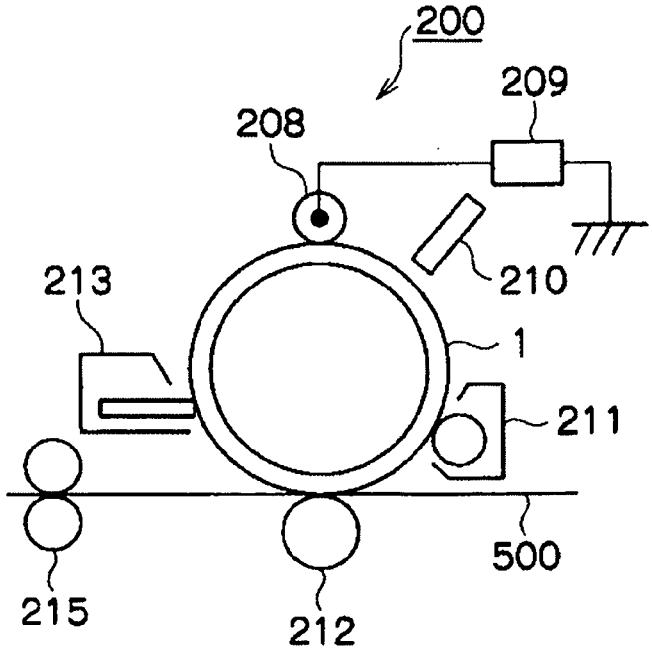
FIG. 2 is a schematic diagram showing a basic configuration of the image forming apparatus according to the present exemplary embodiment.

FIG. 2 schematically shows a basic configuration of the image forming apparatus of the first exemplary embodiment.

The image forming apparatus 200 shown in FIG. 2 includes, for example, the electrophotographic photoreceptor 1 of the exemplary embodiment; a charging device 208 (charging unit) in a contact charging mode, that is connected to a power source 209 to charge the electrophotographic photoreceptor 1; an exposure device 210 (electrostatic latent image forming unit) that exposes the electrophotographic photoreceptor 1 charged by the charging device 208 to form an electrostatic latent image; a developing device 211 (developing unit) that develops the electrostatic latent image formed by the exposure device 210 by a developer containing a toner to form a toner image; a transfer device 212 (transfer unit) that transfers the toner image formed on the surface of the electrophotographic photoreceptor 1 onto a transfer medium 500; a toner removing device 213 (toner removing unit) that removes the toner remaining on the surface of the electrophotographic photoreceptor 1 after the transfer; and a fixing device 215 (fixing unit) that fixes the toner image transferred onto the transfer medium 500 in the transfer medium 500.

Figure 3:
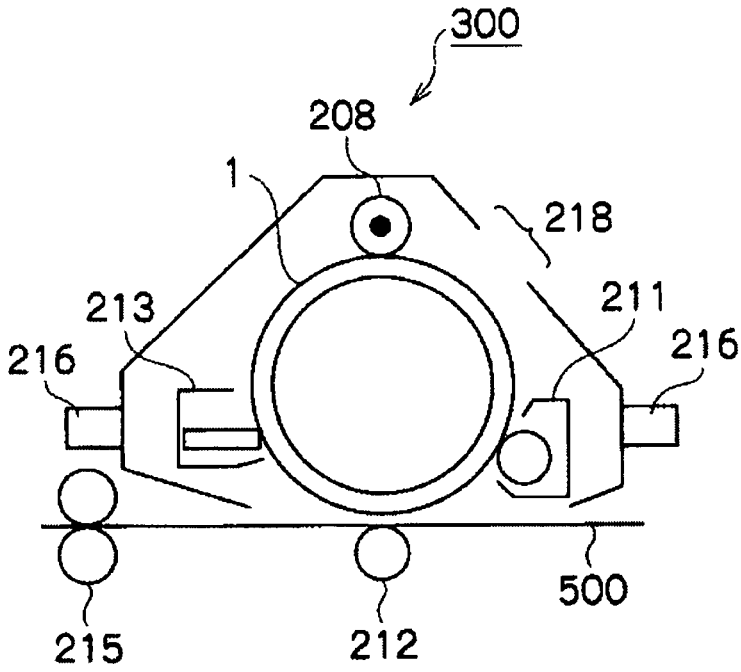
FIG. 3 is a schematic diagram showing a basic configuration of an example of the process cartridge according to the present exemplary embodiment.

Furthermore, the image forming apparatus 200 shown in FIG. 3 is an image forming apparatus in an erase-less mode, not including an erasing unit that removes the charges remaining on the surface of an electrophotographic photoreceptor after the toner image on the surface of the electrophotographic photoreceptor is transferred.

The charging device 208 has a charging member, and when the photoreceptor 1 is charged, voltage is applied to the charging member. As for the voltage range, only DC voltage is applied in the present exemplary embodiment, and accordingly, the voltage may be applied in a mode for applying a DC voltage in the range of positive or negative values from 50 V to 2000 V (preferably from 200 V to 1000 V, and more preferably from 300 V to 700 V), varying depending on the required charging potential of the electrophotographic photoreceptor 1.

Examples of the charging member include a roller, a brush, and a film. Among these, examples of the roller-shaped charging member (which may be hereinbelow referred to a "charging roller" in some cases) include ones constituted with materials having an electric resistivity adjusted to a range of $10^3\Omega$ to $10^8\Omega$. Further, the charging roller may be constituted with single layer or plural layers.

When the charging roller is used as the charging member, the pressure applied to the photoreceptor 1 may be, for example, in the range of 250 mgf to 600 mgf.

Examples of the materials constituting the charging member include ones having synthetic rubber such as urethane rubber, silicone rubber, fluorine rubber, chloroprene rubber, butadiene rubber, EPDM (ethylene-propylene-diene copolymerization rubber), and epichlorohydrin rubber or elastomers constituted with polyolefin, polystyrene, vinyl chloride or the like, as major materials and also having conductivity imparting agents such as conductive carbon, metal oxide, and an ion conducting agent blended therein in the appropriate amounts.

In addition, a paint may be formed by using a resin such as nylon, polyester, polystyrene, polyurethane, and silicone, and a conductivity imparting agent such as conductive carbon, metal oxide, and an ion conducting agent may be blended in appropriate amounts therewith, and then the obtained paint may be used by laminating with a dipping method, a spraying method, a roll-coating method or the like.

In the case where the charging roll is used as the charging member, by bringing the charging roll into contact with the surface of the photoreceptor 1, the charging unit rotates in accordance with the photoreceptor 1 even when the charging unit does not include a driving unit, but may rotate at a peripheral speed different from that of the photoreceptor 1 by mounting a driving unit in the charging roll.

As the exposure device 210, a known exposure unit is used. Specifically, for example, an apparatus in an optical system for exposure through a light source such as a semiconductor laser, LED (Light Emitting Diode), and a liquid crystal shutter is used. The light amount during writing may be, for example, in the range of 0.5 $mJ/m^2$ to 5.0 $mJ/m^2$ on the surface of the photoreceptor.

Examples of the developing device 211 include a developing unit in a two-component developing mode, in which a developing brush (developer holding member) to which a developer containing a carrier and a toner is attached is brought into contact with an electrostatic latent image holding member to perform the development; and a developing unit in a contact-type single-component developing mode, in which a toner is attached onto a conductive rubber elastomer transporting roll (developer holding member) to develop the toner in the electrostatic latent image holding member.

The toner is not particularly limited as long as it is a known toner. Specifically, it may be, for example, a toner containing at least a binder resin, and if necessary, a colorant, a release agent or the like.

The method for preparing a toner is not particularly limited, but examples thereof include a method for preparing a toner, using an ordinary pulverization method, a wet-melting globularization method for preparation in a dispersion medium, and a polymerization method such as suspension polymerization, dispersion polymerization, and an emulsion polymerization aggregation method in the related art.

When the developer is a two-component developer containing a toner and a carrier, the carrier is not particularly limited, and examples thereof include carriers including only core materials, for example, magnetic metals such as iron oxide, nickel, and cobalt, and magnetic oxides such as ferrite and magnetite (uncoated carriers); and resin-coated carriers which have a resin layer provided on the surface of these core materials. The mixing ratio (weight ratio) of the toner to the carrier (toner:carrier) in the two-component developer may be in the range of 1:100 to 30:100 or may be in the range of 3:100 to 20:100.

Examples of the transfer device 212 include, in addition to roller-shaped contact type charging members, a contact type transfer charger using, for example, a belt, film, or a rubber blade, or a scorotron transfer charger or corotron transfer charger using corona discharge.

The toner removing device 213 is used to remove the remaining toner attached on the surface the electrophotographic photoreceptor 1 after the transfer, whereby the electrophotographic photoreceptor 1 having the cleaned surface is provided by carrying out the image forming process repeatedly. For the toner removing device 213, for example, brush cleaning or roll cleaning is used, in addition to a foreign matter-removing member (cleaning blade), but among these, a cleaning blade is preferably used. Further, examples of the material for the cleaning blade include urethane rubber, neoprene rubber, and silicone rubber.

Furthermore, in the case where there is no problem with the remaining toner, for example, in the case where the toner does not easily remain on the surface of the photoreceptor 1, it is not necessary to provide the toner removing device 213.

A basic process of the image forming apparatus 200 for setting the image will be described.

First, the charging device 208 charges the surface of the photoreceptor 1 to a predetermined potential. Next, the surface of the charged photoreceptor 1 is exposed by an exposure device 210, based on the image signal, to form an electrostatic latent image.

Then, the developer is held on the developer holding member of the developing device 211, the held developer is transported to the photoreceptor 1, and fed to the electrostatic latent image at a position where the developer holding member and the photoreceptor 1 are close to each other (or in contact with each other). Consequently, the electrostatic latent image is visualized to become a toner image.

The developed toner image is transported to the position of the transfer device 212, and directly transferred to the transfer medium 500 by the transfer device 212.

Then, the transfer medium 500 to which the toner image is transferred is transported to a fixing device 215, and the toner image is fixed on the transfer medium 500 by the fixing device 215. The fixing temperature may be, for example, from 100° C. to 180° C.

On the other hand, after the toner image is transferred to the transfer medium 500, the toner particles that are not transferred and remain on the photoreceptor 1 are moved to the position in contact with the toner removing device 213, and recovered by the toner removing device 213.

Consequently, an image is formed by the image forming apparatus 200.

Process Cartridge

FIG. 3 schematically shows a basic configuration of an example of the process cartridge according to the present exemplary embodiment. This process cartridge 300 is integrated by combining an electrophotographic photoreceptor 1; a charging device 208 in a contact charging mode, that charges the electrophotographic photoreceptor 1; a developing device 211 that develops the electrostatic latent image formed on the electrophotographic photoreceptor 1 by the exposure using a developer containing a toner to form a toner image; a toner removing device 213 that removes the toner remaining on the surface of the electrophotographic photoreceptor 1 after the transfer; and an opening for exposure 218 using an attachment rail 216.

Moreover, this process cartridge 300 is configured to be attachable to or detachable from the main member of an image forming apparatus including a transfer device 212 that transfers the toner image formed on the surface of the electrophotographic photoreceptor 1 onto the transfer medium 500; a fixing device 215 that fixes the toner image transferred onto the transfer medium 500 on the transfer medium 500; and other components not shown, and the process cartridge 300 constitutes the image forming apparatus together with the main member of the image forming apparatus.

The process cartridge 300 may include an exposure device (not shown) that exposes the surface of the electrophotographic photoreceptor 1, in addition to the electrophotographic photoreceptor 1, the charging device 208, the developing device 211, the toner removing device 213, and the opening for exposure 218.

In addition, the process cartridge according to the present exemplary embodiment may include at least the electrophotographic photoreceptor 1 and the charging device 208.

EXAMPLES

Hereinbelow, the invention will be described in detail with reference to Examples, but is not construed to be limited to Examples. Further, "%" is based on weight unless otherwise specified.

Preparation of Electrophotographic Photoreceptor

Example 1

Preparation of Photoreceptor 100 parts by weight of zinc oxide (average particle diameter: 70 nm, manufactured by Tayca Corporation, and specific surface area: 15 $m^2/g$) is mixed with 500 parts by weight of methanol under stirring. 1.0 part by weight of KBM603 (N-2-(aminoethyl)-3-aminopropyltrimethoxysilane, manufactured by Shin-Etsu Chemical Co., Ltd.) as a silane coupling agent is added thereto, followed by stirring for 2 hours. Thereafter, methanol is evaporated by distillation under reduced pressure, and printing is carried out at 120° C. for 3 hours to obtain zinc oxide particles that have been surface-treated with a silane coupling agent.

100 parts by weight of the surface-treated zinc oxide particles as the metal oxide particles, 1 part by weight of alizarin as an electron accepting compound having an anthraquinone structure, 22.5 parts by weight of blocked isocyanate (SUMIDULE BL 3175, manufactured by Sumitomo Bayer Urethane Company Ltd.) as a curing agent, and 25 parts by weight of a butyral resin (S-Lec BM-1, manufactured by Sekisui Chemical Co, Ltd.) are dissolved in 142 parts by weight of methyl ethyl ketone to give a solution. 38 parts by weight of this solution is mixed with 25 parts by weight of methyl ethyl ketone, and the mixture is dispersed in a sand mill using glass beads having a diameter of 2 mm for 30 hours to give a dispersion. 0.005 parts by weight of dioctyl tin dilaurate as a catalyst and 4.0 parts by weight of silicone resin particles (TOSPEARL 130, manufactured by GE Toshiba Silicones Co., Ltd.) are added to the obtained dispersion to give a coating solution for an undercoat layer. The coating liquid is applied on an aluminum substrate having a diameter of 30 mm by a dip coating method, and dried at 170° C. for 25 minutes to obtain an undercoat layer having a thickness of 25 μm.

Next, a mixture of 15 parts by weight of chlorogallium phthalocyanine crystals having strong diffraction peaks at least at 7.4°, 16.6°, 25.5°, and 28.3° of Bragg angles (2θ±0.2° with respect to CuKα characteristic X rays as a charge generating material, 10 parts by weight of a vinyl chloride-vinyl acetate copolymer resin (VMCH, manufactured by Nippon Unicar Company Limited), and 300 parts by weight of n-butyl alcohol is dispersed in a sand mill for 4 hours using glass beads having a diameter of 1 mm to obtain a coating liquid for a charge generating layer. The coating liquid for a charge generating layer is dip-coated on the above-described undercoat layer, and dried to obtain a charge generating layer having a thickness of 0.2 μm.

Next, 4 parts by weight of N,N'-diphenyl-N,N'-bis(3-methylphenyl)-[1,1']biphenyl-4,4'-diamine as a charge transporting material, 6 parts by weight of a bisphenol Z-type polycarbonate resin (viscosity average molecular weight: 40,000) as a binder resin, and 1 part by weight of 2,6-di-t-butyl-4-methylphenol as an antioxidant are mixed, and 24 parts by weight of tetrahydrofuran and 11 parts by weight of toluene are mixed therewith and dissolved therein. Then, 10 ppm of fluorine-modified silicone oil (trade name: FL-100, manufactured by Shin-Etsu Chemical Co., Ltd.) is added thereto, and the mixture is sufficiently stirred to obtain a coating liquid for forming a charge transporting layer.

This coating liquid is coated on the charge generating layer, and dried at 140° C. for 25 minutes to form a charge transporting layer having a film thickness of 25 μm, thereby obtaining a desired electrophotographic photoreceptor.

The electrophotographic photoreceptor thus obtained is taken as the photoreceptor 1.

Measurement of Volume Resistivity of Undercoat Layer

Preparation of Measurement Sample

The coating liquid for an undercoat layer used in the preparation of the photoreceptors of Examples and Comparative Examples is coated on an aluminum plate by a blade coating method, and dried and cured at 170° C. for 24 minutes. With respect to the single-layer film of the undercoat layer, a gold electrode having a dimension of 100 nm is mounted as an opposite electrode by a vacuum deposition method and used for measurement of resistivity.

Measurement Method

For the measurement of impedance, an SI 1287 electrochemical interface (manufactured by TOYO Corporation) is used as a power source, an SI 1260 impedance/gain phase analyzer (manufactured by TOYO Corporation) is used as an ammeter, and a 1296 dielectric interface (manufactured by TOYO Corporation) is used as a current amplifier.

In a sample for impedance measurement, an aluminum pipe is used as a cathode and a gold electrode is used as an anode, an AC voltage with 1 Vp-p is applied from the high-frequency side in the frequency range of 1 MHz to 1 mHz, and the AC impedance of each sample is measured at room temperature (22° C., 55% RH) By fitting a graph with the Cole-Cole plot obtained in the measurement to the equivalent circuit of parallel RC, the volume resistivity is obtained. The volume resistivity is shown in Table 1.

Surface Potential Difference between Exposure Portion and Non-Exposure Portion

The electrophotographic photoreceptor 1 is mounted on a modified device obtained by removing an erasing unit from DocuPrint C2110 "device configured to carryout direct transfer from the electrophotographic photoreceptor to paper by applying DC voltage −600 V to a charging roll to charge an electrophotographic photoreceptor in a contact charging mode, and applying a voltage of 1500 V to 2000 V to a transfer roll", and charging, exposure (upper half of the electrophotographic photoreceptor), and transfer are carried out once each sequentially. Then, when charging and exposure (front surface) are carried out the surface potential of the upper half of the electrophotographic photoreceptor (having an exposure history in the previous cycle) and the lower half of the electrophotographic photoreceptor (having no exposure history in the previous cycle) are measured using the electrostatic voltmeter Trek 334 (manufactured by TREK JAPAN Co., Ltd.), and the difference in the surface potential is defined as a surface potential difference ΔVh at the exposure portion and the non-exposure portion. The results are shown in Table 1.

The evaluation criteria are as follows. Further, Paper C2 manufactured by Fuji Xerox is used as paper.

The evaluation criteria are as follows.

A: Density unevenness is not generated.

B: Slight density unevenness is generated at an acceptable level.

C: Density unevenness is generated at a poor level with no edge in the light part.

D: Density unevenness is generated at a poor level with an edge noticeable in the concentrated and light parts.

Image Density Unevenness

Figure 4:
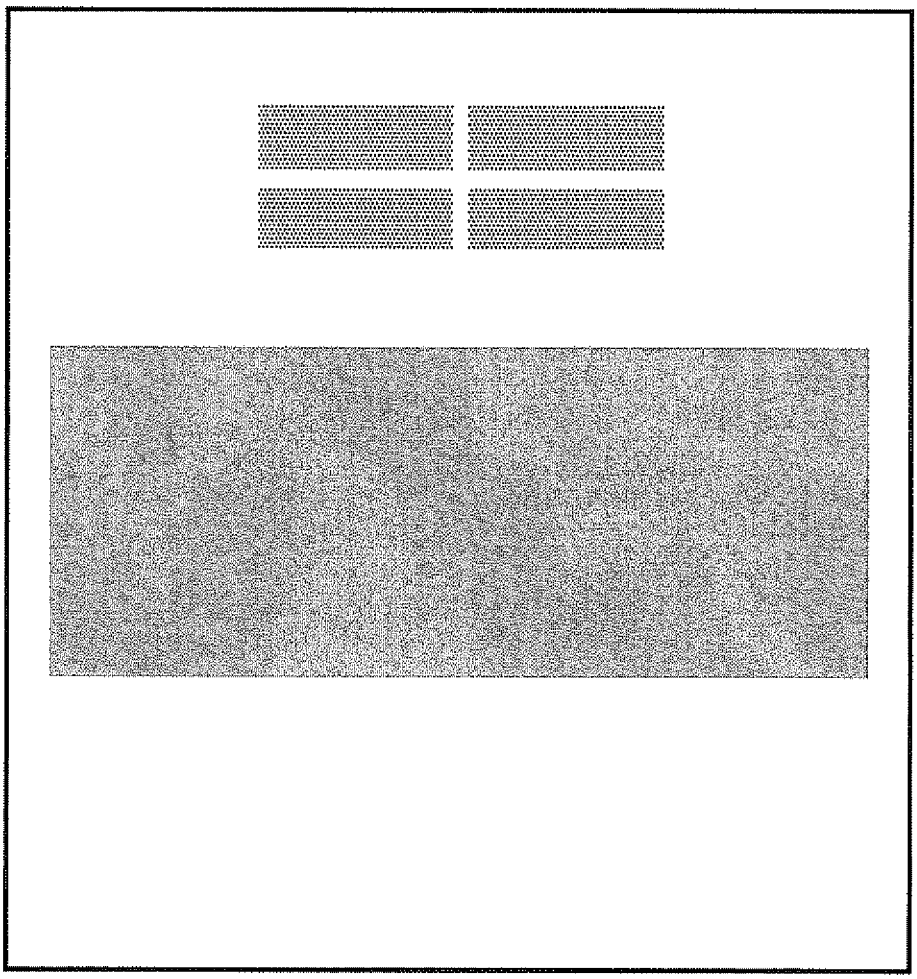
FIG. 4 is a mimetic diagram showing an image formed by the evaluation of Examples.

Using the above-described DocuPrint C2110 modified device, charging, exposure, and transfer are carried out sequentially in the same manner to print an image shown in FIG. 4 (solid image (image density 100%) and a halftone image (image density 30%) and to evaluate the density unevenness of the halftone part shown in FIG. 4. The results are shown in Table 1.

Example 2

In the same manner as in Example 1 except that the addition amount of alizarin is changed to 3 parts by weight and the temperature for drying the undercoat layer is changed to 185° C., a photoreceptor is prepared and evaluated in the same manner.

Example 3

In the same manner as in Example 1 except that the addition amount of alizarin is changed to 3 parts by weight and the temperature for drying the undercoat layer is changed to 180° C., a photoreceptor is prepared and evaluated in the same manner.

Example 4

In the same manner as in Example 1 except that the addition amount of alizarin is changed to 3 parts by weight and the temperature for drying the undercoat layer is changed to 175° C., a photoreceptor is prepared and evaluated in the same manner.

Example 5

In the same manner as in Example 1 except that the addition amount of alizarin is changed to 5 parts by weight and the temperature for drying the undercoat layer is changed to 180° C., a photoreceptor is prepared and evaluated in the same manner.

Example 6

In the same manner as in Example 1 except that 1 part by weight of quinizarin is added instead of alizarin, a photoreceptor is prepared and evaluated in the same manner.

Example 7

In the same manner as in Example 3 except that 3 parts by weight of quinizarin is added instead of alizarin, a photoreceptor is prepared and evaluated in the same manner.

Comparative Example 1

In the same manner as in Example 1 except that the addition amount of alizarin is changed to 0.5 parts by weight, a photoreceptor is prepared and evaluated in the same manner.

Comparative Example 2

In the same manner as in Example 1 except that alizarin is not added, a photoreceptor is prepared and evaluated in the same manner.

Comparative Example 3

In the same manner as in Example 1 except that the addition amount of alizarin is changed to 6 parts by weight and the temperature for drying the undercoat layer is changed to 190° C., a photoreceptor is prepared and evaluated in the same manner.

Comparative Example 4

In the same manner as in Example 1 except that the addition amount of alizarin is changed to 6 parts by weight and the temperature for drying the undercoat layer is changed to 185° C., a photoreceptor is prepared and evaluated in the same manner.

Comparative Example 5

In the same manner as in Example 1 except that the addition amount of alizarin is changed to 6 parts by weight and the temperature for drying the undercoat layer is changed to 175° C., a photoreceptor is prepared and evaluated in the same manner.

Comparative Example 6

In the same manner as in Example 1 except that the addition amount of alizarin is changed to 3 parts by weight and the temperature for drying the undercoat layer is changed to 165° C., a photoreceptor is prepared and evaluated in the same manner.

The results of the respective Examples are shown in Table 1.

TABLE 1

| | Undercoat layer of electrophotographic photoreceptor | | | | |
|---|---|---|---|---|---|
| | Electron accepting compound | | | Evaluation | |
| | Kind | Parts by weight with respect to 100 parts by weight of metal oxide particles | Volume resistivity (Ωm) | Surface potential difference between exposure portion and non-exposure portion ΔVh (V) | Density unevenness |
| Ex. 1 | Alizarin | 1 | $1.0 \times 10^9$ | 17 | B |
| Ex. 2 | Alizarin | 3 | $3.5 \times 10^8$ | 15 | B |
| Ex. 3 | Alizarin | 3 | $5.5 \times 10^8$ | 10 | A |
| Ex. 4 | Alizarin | 3 | $1.0 \times 10^9$ | 15 | B |
| Ex. 5 | Alizarin | 5 | $5.5 \times 10^8$ | 14 | B |
| Ex. 6 | Quinizarin | 1 | $3.8 \times 10^8$ | 16 | B |
| Ex. 7 | Quinizarin | 3 | $8.8 \times 10^8$ | 7 | A |
| Comp. Ex. 1 | Alizarin | 0.5 | $5.0 \times 10^7$ | 20 | C |
| Comp. Ex. 2 | Alizarin | 0 | $2.5 \times 10^7$ | 30 | D |
| Comp. Ex. 3 | Alizarin | 6 | $1.2 \times 10^8$ | 27 | D |
| Comp. Ex. 4 | Alizarin | 6 | $5.0 \times 10^8$ | 22 | C |
| Comp. Ex. 5 | Alizarin | 6 | $3.0 \times 10^9$ | 35 | D |
| Comp. Ex. 6 | Alizarin | 3 | $4.5 \times 10^9$ | 32 | D |

From the above-described results, it may be seen that in the present Examples, favorable results from the evaluation of the surface potential difference and the density unevenness of the exposure and the non-exposure portion are obtained, as compared with Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, which comprises at least:

an electrophotographic photoreceptor having at least a conductive support, an undercoat layer provided on the conductive support, containing metal oxide particles and an electron accepting compound having an anthraquinone structure with an amount of the electron accepting compound being from 2 parts by weight to 4 parts by weight with respect to 100 parts by weight of the metal oxide particles, and having a volume resistivity, as measured by an AC impedance method, in a range of $4.5\times10^8$ Ωm to $9.0\times10^8$ Ωm, and a photosensitive layer provided on the undercoat layer;

a charging device that charges a surface of the electrophotographic photoreceptor in a contact charging mode, in which only DC voltage is applied;

an electrostatic latent image forming device that exposes the surface of the charged electrophotographic photoreceptor to form an electrostatic latent image;

a developing device that develops the electrostatic latent image by a developer to form a toner image; and a transfer device that directly transfers the toner image from the electrophotographic photoreceptor to a transfer medium; and which does not comprise an erasing device for erasing the surface of the electrophotographic photoreceptor after the toner image is transferred onto the transfer medium by the transfer device and before the surface of the electrophotographic photoreceptor is charged by the charging device.

2. The image forming apparatus according to claim 1, wherein the electron accepting compound is an electron accepting compound represented by the following formula (1):

Formula (1)

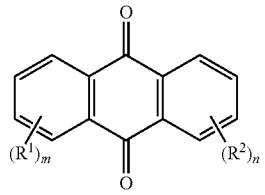

wherein $R^1$ and $R^2$ each independently represent a hydroxyl group, a methyl group, a methoxymethyl group, a phenyl group, or an amino group, and m and n each independently represent an integer of 0 to 4.

3. The image forming apparatus according to claim 2, wherein in the electron accepting compound represented by the formula (1), $R^1$ is a hydroxyl group, m is from 1 to 3, and n is 0.

4. The image forming apparatus according to claim 1, wherein the electron accepting compound is an electron accepting compound having a hydroxyanthraquinone structure.

5. The image forming apparatus according to claim 1, wherein the metal oxide particles are surface-treated with a silane coupling agent.

6. The image forming apparatus according to claim 5, wherein an amount of the silane coupling agent attached on the surface of 100 parts by weight of the metal oxide particles is from 0.5 part by weight to 3 parts by weight.

7. The image forming apparatus according to claim 1, wherein the metal oxide particles are surface-treated with a silane coupling agent having an amino group.

* * * * *